United States Patent [19]

Clerx et al.

[11] 3,937,919

[45] Feb. 10, 1976

[54] FIXING DEVICE

[75] Inventors: Henricus P. M. Clerx, Baarlo; Pieter M. J. Extra, Belfeld; Leonardus L. M. Keursten; Franciscus M. J. Peeters, both of Grubbenvorst, all of Netherlands

[73] Assignee: Océ-van der Grinten N.V., Venlo, Netherlands

[22] Filed: Oct. 30, 1973

[21] Appl. No.: 411,291

[30] Foreign Application Priority Data

Nov. 8, 1972 Netherlands ..... 7215064
Sept. 17, 1973 Netherlands ..... 7312749

[52] U.S. Cl. ..... 219/216; 29/121 R; 219/469; 432/60; 432/228

[51] Int. Cl.[2] ..... H05B 1/00

[58] Field of Search ..... 219/216, 388, 469–471; 100/93 RP; 93/DIG. 1; 432/60, 228; 29/121 R, 130, 132; 118/637; 117/17.5; 355/9, 3 R; 427/261

[56] References Cited

UNITED STATES PATENTS

| | | | |
|---|---|---|---|
| 2,685,548 | 8/1954 | Drozdowski | 29/130 X |
| 3,291,466 | 12/1966 | Aser et al. | 432/228 X |
| 3,401,439 | 9/1968 | Staats et al. | 219/469 X |
| 3,588,978 | 6/1971 | Bradford | 29/121 R |
| 3,809,861 | 5/1974 | Bruan | 100/93 RP |

*Primary Examiner*—C. L. Albritton
*Attorney, Agent, or Firm*—Albert C. Johnston

[57] ABSTRACT

For fixing electrostatically formed images of thermoplastic powder on copy sheets, an elastic roller and a heated rigid roller form a nip through which each sheet is passed with its image side engaged by the elastic roller, and the elastic roller has a pliable annular body formed with circumferential surface grooves or ribs which cooperate with organs of complementary form for separating each sheet from the roller surface behind the nip, yet which provide an even roller surface in the nip by being elastically deformed therein. The rigid roller is formed with circumferential surface grooves which also cooperate with complementary sheet separating organs. The separating organs cooperating with grooves may be blades extending into them behind the nip, or wires extending in them through the nip; those cooperating with ribs may be blades having profiled edges held almost in contact with ribbed regions of the elastic roller surface.

32 Claims, 22 Drawing Figures

FIXING DEVICE

Figure 1:
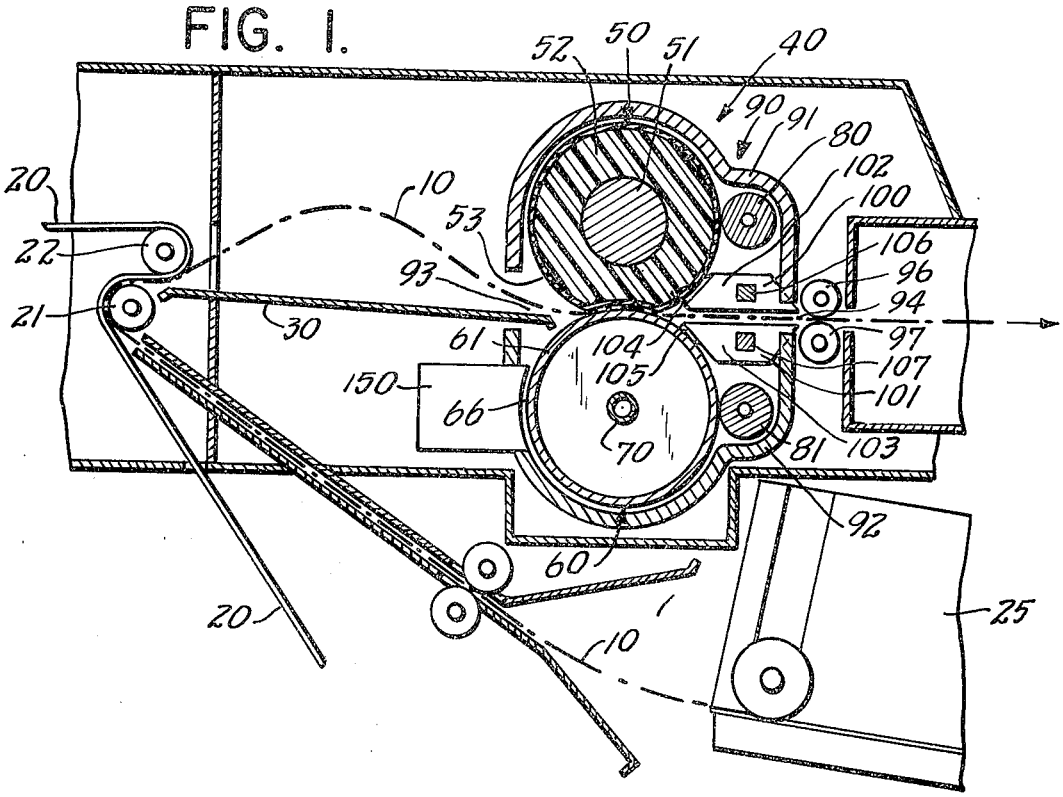

The invention relates to a device for fixing a thermoplastic powder-image, obtained electrostatically, on a support, which device consists of two rolls which together form a nip through which the support is transported, whereby the roll that is in contact with the image-side of the support is provided with an elastically pliable sleeve and the other roll with a hard non-pliable sleeve. Such a device is described in the U.S. Pat. Nos. 3,669,707 and 3,449,548.

In fixing devices with rolls usually two problems occur. The first problem is to prevent the transfer of powder particles on the roll which contacts the image-side of the support (so-called offset). Powder particles which are thus transferred to the circumference of the roll, will afterwards partially be retransferred on the same or on another image support, so that an impure image is produced. It is also possible, that the powder particles are transferred from the first roll to the second roll and subsequently to the rear side of an image support, so that the rear side becomes dirty.

This problem can be solved by selecting a suitable material for covering the roll which contacts the powder image. Suitable materials are polymers of fluorohydrocarbons and elastomers of silicons. When using these materials, the transfer of powder particles can indeed be precluded, but troubles can occur because the support does not properly get loose from the roll.

This is the second problem relating to fixing devices of this type. Especially when using polytetrafluoroethylene, the support appears to adhere very strongly to the surface of the roll. If the support is loosened from the roll, for which anyhow much force is required, it appears that the powder image is sticking integrally on the support and consequently that no transfer takes place to the surface of the roll.

In order to solve this second problem, the rolls are oiled with a separation-means, such as for instance silicon-oil. When this takes place by means of an oil pad the extra effect gained is, that the roll is also cleaned.

However, the use of silicon-oil also has some disadvantages. Thus it is necessary to add the silicon-oil regularly, whereas a thin layer of silicon-oil is always transferred to the image support, for instance paper, so that it becomes more difficult to write on it.

It appears that, when using elastomers of silicone, no transfer of powder particles takes place, but also then sticking problems occur, although to a smaller degree. Also here a separation-means, such as silicon-oil, can give a solution, but this is attended by the disadvantages mentioned.

The object of the invention is to provide a device of the type mentioned, in which the disadvantages mentioned are prevented and particularly in which the image support will definitely come loose from the rolls.

According to one feature of the invention, the elastically pliable roller is provided with one or more circumferential grooves, with each of which a scraping organ cooperates, and the width of the groove is chosen so that the grooves are completely closed in the nip between the rollers.

Surprisingly, it has been found possible to provide in the elastic roller surface grooves which become fully closed in the nip between the rollers. That roller surface is made so even in the nip that no reproduction of the grooves, for instance in the form of unfixed streaks, becomes visible on the fixed copy sheet.

According to another feature of the invention, the relatively hard, non-pliable surface of the roller that presses against the non-image side of the support is also provided with one or more circumferential grooves with each of which a scraping organ cooperates.

The scraping organ can be designed as a scraping knife extending in the pertaining circumferential groove, or as a wire extending in the pertaining circumferential groove and almost completely filling up the part of the groove which is situated in the nip of the rollers.

According to a further feature of the invention, the stated object is attained by utilizing in contact with the image side of the support an elastically pliable roller, the pliable body or sleeve of which is provided with one or more elastically pliable riblike thickenings which are sufficiently small in protending volume that they are depressed so as to create a fully even surface in the nip between the rollers. Behind the nip the thickenings return to their normal form and thus remove the sheet from the roller surface. To assure the removal of each sheet the riblike thickenings cooperate with scraping organs in the form of plates having a scraping edge of complementary configuration.

Figure 2:
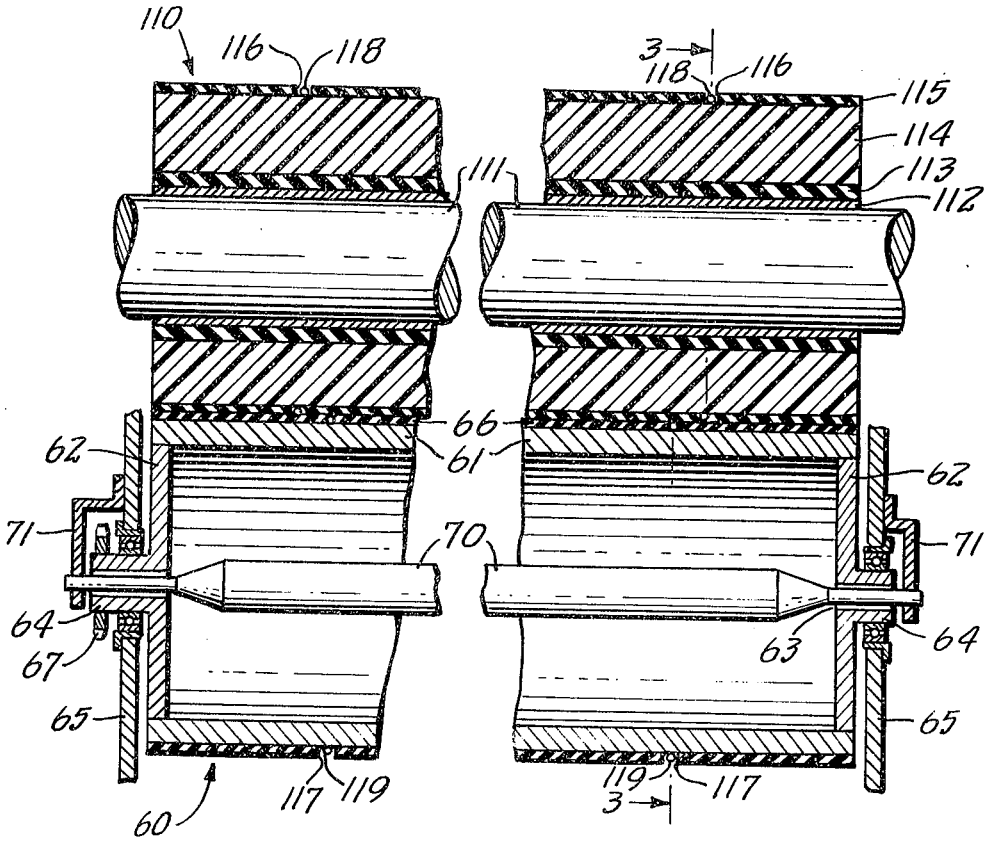
Figure 3:
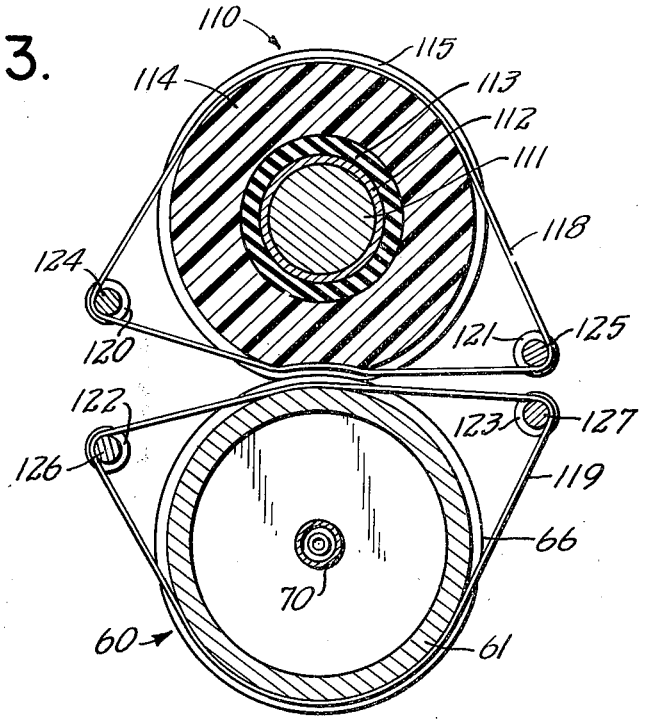
Figure 4:
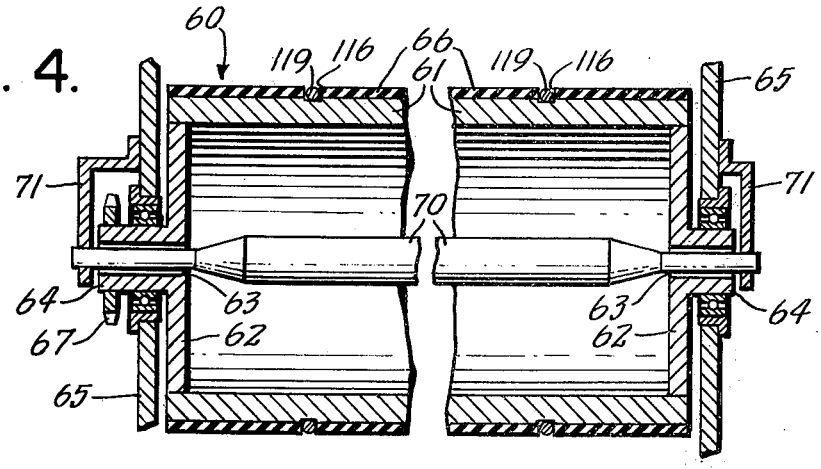
Figure 5:
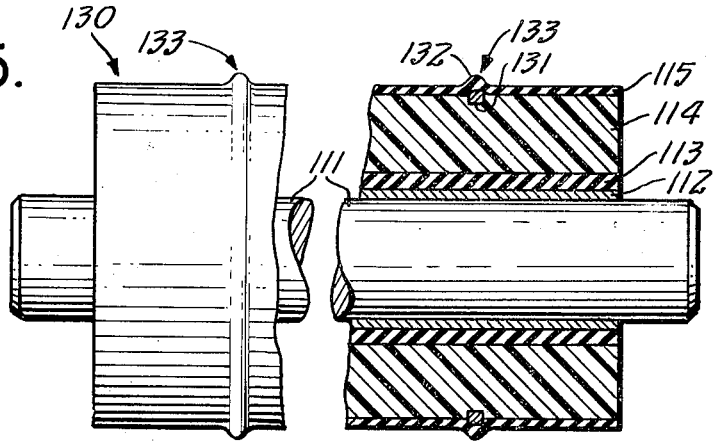
Figure 6:
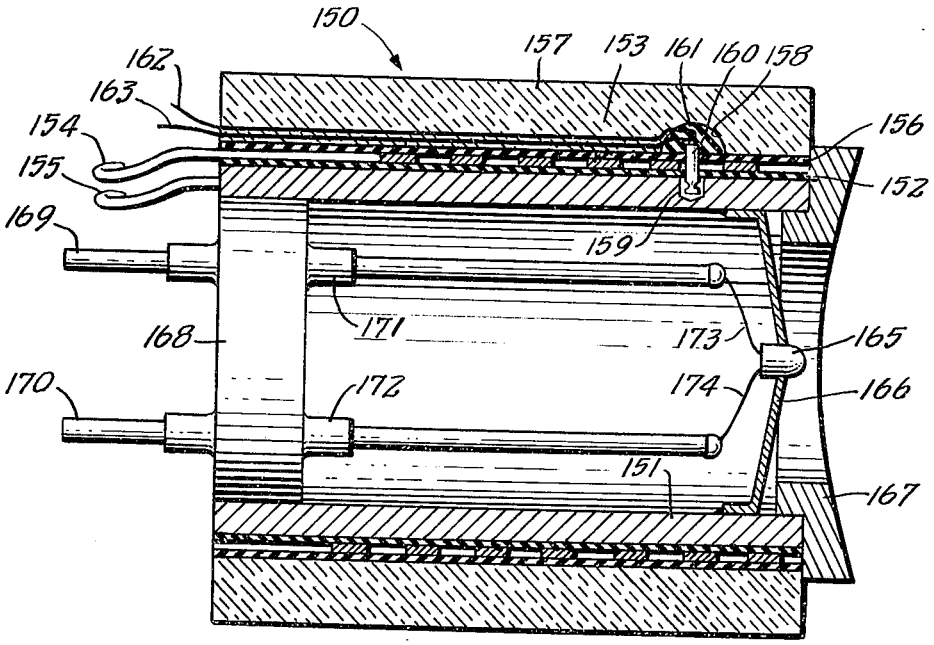
Figure 7:
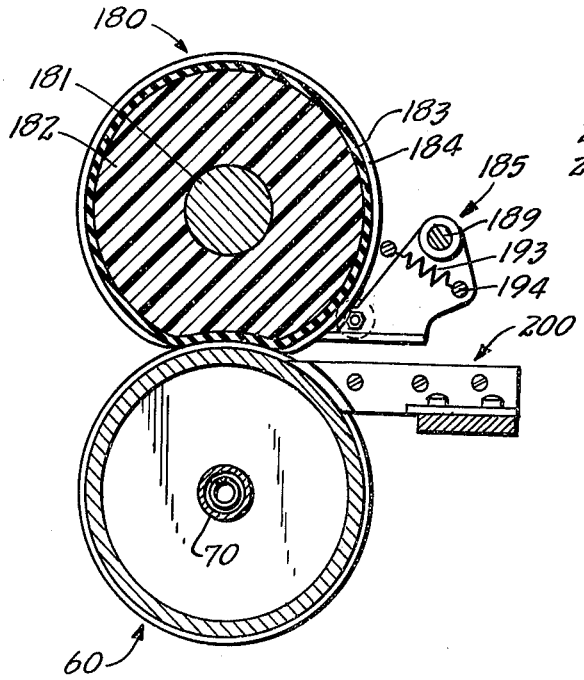
Figure 8:
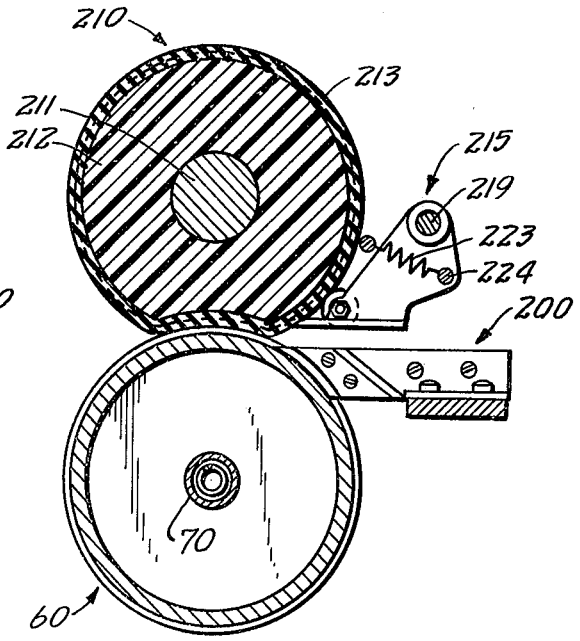
Figure 9:
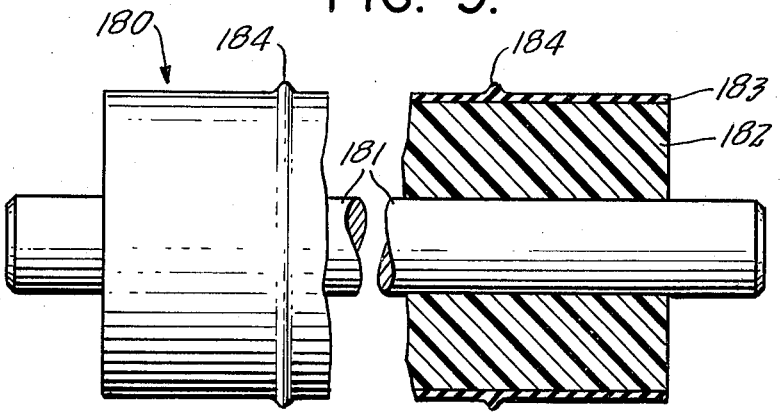
Figure 10:
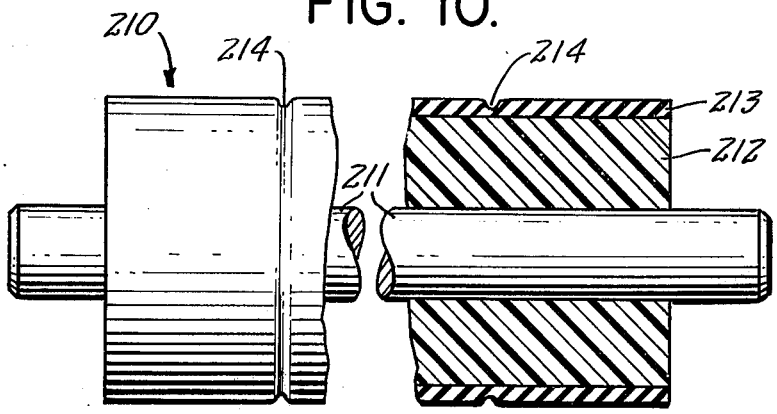
Figure 11:
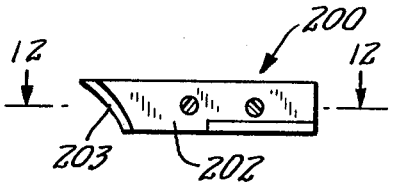
Figure 19:
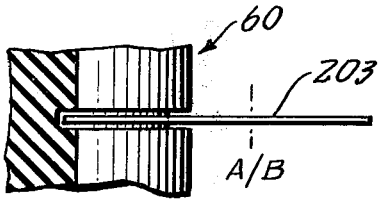
Figure 12:
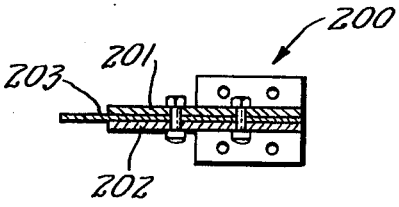
Figure 20:
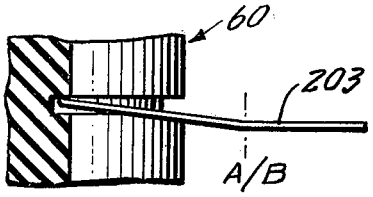
Figure 13:
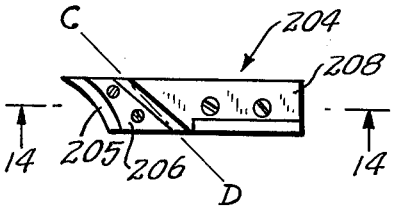
Figure 15:
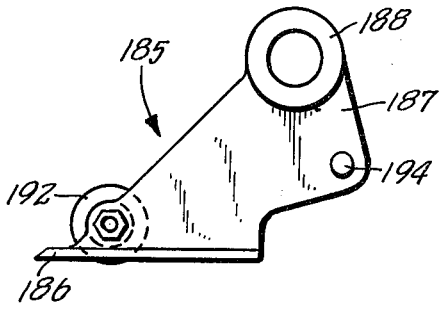
Figure 14:
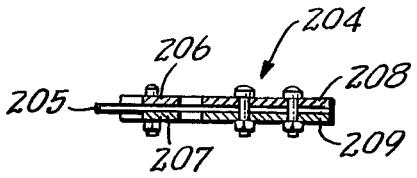
Figure 16:
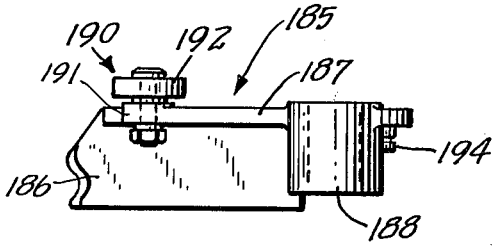
Figure 21:
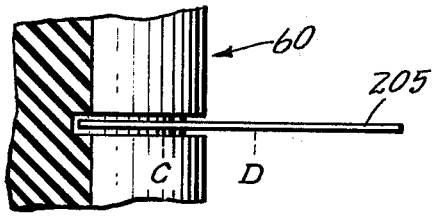
Figure 17:
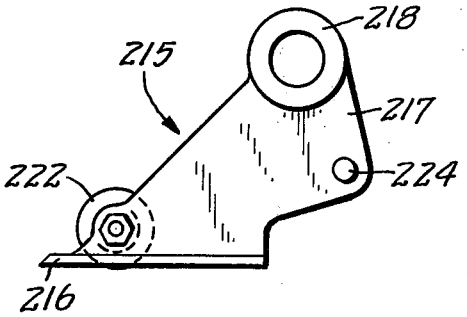
Figure 22:
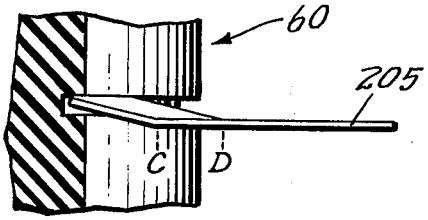
Figure 18:
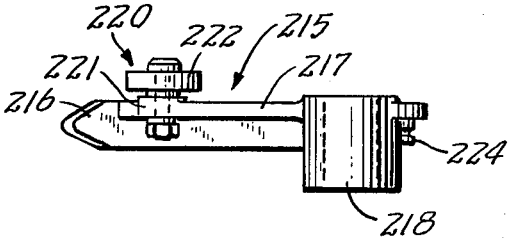

Other characteristics and advantages of the invention will become clear from the following description, whereby reference is made to the drawings added, in which:

FIG. 1 is a schematic section of a part of an electrophotographic copying apparatus with a contact fixing device according to the invention, FIG. 2 is an axial section of another embodiment of the contact fixing device according to the invention, FIG. 3 is a section according to the line III—III of FIG. 2, FIG. 4 is an axial section of a modified embodiment of a roll which can be used in a contact fixing device according to the invention, FIG. 5 represents, partially in view and partially in axial section, a modified embodiment of a roll which can be used in a contact fixing device according to the invention, FIG. 6 is a section of a temperature-meter which is preferably used for regulating the temperature of at least one of the rolls of a contact fixing device according to the invention, FIG. 7 is a schematic section of a third embodiment of the contact fixing device according to the invention, FIG. 8 is a schematic section of a fourth embodiment of the contact fixing device according to the invention, FIG. 9 represents, partially in view and partially in axial section, a modified embodiment of the upper roll of the contact fixing device according to FIG. 7, FIG. 10 represents, partially in view and partially in axial section, a modified embodiment of the upper roll of the contact fixing device according to FIG. 8, FIG. 11 is a side-view of a scraping knife which can be used in connection with the lower roll of the contact fixing device according to FIGS. 7 or 8, FIG. 12 is a section of the scraping knife according to the line XII—XII in FIG. 11, FIG. 13 is a side-view of another scraping knife which can be used in connection with the lower roll of the contact fixing device according to FIGS. 7 or 8, FIG. 14 is a section of the scraping knife according to the line XIV—XIV in FIG. 13, FIG. 15 is a side-view of a scraping organ which is used in connection with the upper roll of the contact fixing device according to FIG. 7, FIG. 16 is an upper-view of the scraping organ of FIG. 15, FIG. 17 is a side-view of a scraping organ which is used in connection with the upper roll of the contact fixing device according to FIG. 8, FIG. 18 is an upper-view of the scraping organ of FIG. 17, FIGS. 19 and 20 represent schematically the way in which the scraping knife according to FIGS. 11 and 12 will bend, and FIGS. 21 and 22 represent schematically the way in which the scraping knife according to FIGS. 13 and 14 will bend.

FIG. 1 represents a contact fixing device 40, which serves for fixing an image formed by thermoplastic powder on a support 10. This powder image can for instance be obtained electrophotographically on a belt 20 and be transferred between the rolls 21 and 22 on the support 10 which is supplied from a sheet reservoir 25. See description in Dutch patent application No. 7205491.

The support 10 with the powder image to be fixed on it is transported via the guide plate 30 and the rolls 21 and 22 to the fixing device 40, which will be described below in details.

The fixing device 40 consists of two rolls 50 and 60, which together form a nip through which the support 10 with the powder image to be fixed on it is conveyed. In the first embodiment of the invention, represented in FIG. 1, the contact roll 50 (which is the roll which is touched by the powder image) consists of a metal core 51, round which a sleeve 52 made of heat-resistant elastically pliable material, for instance silicon rubber, is applied. Other materials which can be used, are for instance vinyl-polymers, such as polyvinylidenechloride, poly-olefins such as polyethylene and polypropylene, acrylpolymers, such as polyacrylonitrile, epoxyresins, butylrubbers, chloroprene-rubbers, nitrile-rubbers, polyamides, fluoro-rubbers, poly-imides, polybenzimidazoles, polysulfones and polyesters such as polyethyleneterephthalate.

The sleeve 52 may also consist of a foam-like product. Round the sleeve 52 a thin covering 53 is applied, consisting of a material which at working temperature of the fixing device, for instance between 20° and 170°C, possesses repulsive properties with regard to the thermoplastic powder to be fixed. Examples of such materials are silicon-rubbers, provided or not provided with fillers with low surface-energy, poly-imides and fluorohydrocarbonpolymers, such as can be obtained commercially under the names Teflon, Viton A respectively Viton B, KEL-F and PTFE, etc.

The roll 50 can rotate freely in bearings in the frame plates of the machine (which frame plates are not represented) in such a way that the roll 50 touches the roll 60 at a certain pressure, so that the roll 50 is plied and the nip between the rolls 50 and 60 is extended. In order to obtain a sufficient nipping width it is desirable that the hardness of the roll is equal to 20–30 Shore A, preferably about 25 Shore A. This can be obtained by manufacturing the sleeve 52 of a material which possesses the hardness desirable for the roll, and by covering it with a thin elastic coating 53, of which the hardness may be higher, for instance to 40 Shore A, and which possesses the required properties, such as a powder repulsing character and durability. The pressure roll 60 (this is the roll which is not touched by the powder image) consists of a hollow cylinder 61 made of material having good heat-conducting properties, such as copper, aluminium or alloys of these materials, of which the open extremities are closed off by means of covers 62 (see FIGS. 2 and 4). Each cover 62 is provided with a central circular opening 63, round which a cylinder bush 64 is arranged which can rotate in bearings in frame plates 65 of the apparatus. On one of the cylinder bushes 64 a gear 67 is fixed with which the roll 60 can be driven, in FIG. 1 whilst rotating clockwise.

Within the roll 60 a heating element in the form of an infra-red burner 70 is located. This extends according to the axis of the roll 60, whereby its extremities are fixed in metal strips 71, which are fixed against the frame plates 65. During the rotation of the roll 60 the infra-red burner is at standstill, so that the heating of the roll 60 is effected more gradually. Moreover, this facilitates the electrical connection of the infra-red burner 70.

On the outer circumference of the cylinder 61 a covering 66 is applied, which consists of a material which has repulsive properties with regard to the powder used, in which way it is possible to prevent that any powder present on the back of the image support will stick to the roll 60 and will thus pollute the back of following image supports. Further the covering 66 either has heat-conductive properties, or its thickness is so small, that the resistance against heat-conducting can be neglected. Dependent on the embodiment of the scraping organs to be chosen, which will be further described below, the covering may be elastic or non-elastic. Examples of suitable materials are silicon rubbers, whether made heat-conductive or not by the addition of fillers, and fluorohydrocarbonpolymers. In order to obtain thin layers these materials can be applied by fine pulverization.

Against the circumference of the rolls 50 and 60 cleaning rolls 80 respectively 81 are applied, which can rotate freely in the non-represented frame plates. The cleaning rolls 80 and 81 consists of a metal core on which a layer is applied, which layer consists of a material having strongly sticking properties with regard to the powder used. Suitable materials for this purpose are materials used as image support, such as paper, but also other strongly absorbing materials such as natural textile products. The function of the cleaning rolls 80 and 81 is to remove any powder particles which have been transferred to the rolls 50 respectively 60.

The whole unit, consisting of the fixing rolls 50 and 60 and of the cleaning rolls 80 and 81 is installed within a temperature resistent, heat-insulating covering 90 which mainly consists of two dish-like caps 91 and 92 and two side walls not represented, whereby between the caps 91 and 92 a feed-in split 93 and a feed-out split 94 is formed. In the cap 92 a recess is made, along which a temperature meter 150 can be inserted against the roll 60 and with which the temperature of the roll 60 can be regulated. The exact construction of the temperature meter will be explained afterwards.

Behind the feed-out split 94 two transport rolls 96 and 97 are arranged, which together form a nip and of which at least one can be caused to rotate by means of a driving mechanism which is not represented. By means of the pair of rolls 96, 97 the support 10 with the powder image fixed on it is further transported, for instance to the receiving tray for copies.

In a first embodiment of the invention, represented in FIG. 1, the scraping organs according to the invention are arranged between the insulating covering 90 and the rolls 50 and 60.

In the first embodiment of the invention the scraping organs consist of scraping knives 100 respectively 101, whereby a number of scraping knives 100, for instance two knives, cooperate with the roll 50, and a number of scraping knives 101, for instance two knives, cooperate with the roll 60. The knives 100 and 101 consist of holders 102 and 103, which in the axial direction of the rolls have such a width, for instance 1 cm, that the image support can be transported through these holders 102 and 103 without damage, and of knife blades 104 and 105 with a thickness in the size of a few tenths of millimeters, for instance 0.2 mm. The holders 102 and 103 are provided with square-shaped openings with which the scraping knives can be shoven on square-shaped rods 106 and 107, which rods are fixed in the non-represented frame plates.

This is arranged in such a way, that the knife blades 104 and 105 are situated in perpendicular direction to the axis of the rolls 50 and 60.

The knife blades 104 and 105 cooperate with the circumferential grooves made in the rolls 50 and 60 into which the knife blades 104 and 105 are extending. The circumferential grooves in the roll 50 consist of notches which are obtained by cleaving the outer circumference of the roll 50 with a sharp instrument, for instance a razor blade. The depth of the circumferential grooves in the roll 50 is considerably greater than the thickness of the knife blades 104, for instance 3 to 5 mm. By arranging the circumferential grooves in the roll 50 in this way, it is reached that these circumferential grooves in the nip between the rolls 50 and 60 are forced to close, so that on this place the roll 50 shows a fully even surface.

This has for consequence, that the image support 10 shows no marks of the circumferential grooves in the roll 50. Behind the nip the knife blades 104 force the circumferential grooves in the roll 50 to open, but this only has for consequence that any image support sticking to the roll 50, pushes against these knife blades 104, and is pressed from the roll 50, after which the image support 10 is further transported through the holders 102 and 103.

The circumferential grooves in the rolll 60 are in principle identical to the circumferential grooves in the roll 50. With the roll 60 the circumferential grooves extend in radial direction only as far as the metal cylinder 61. Because the circumferential grooves in the roll 60 have an insufficient depth, the grooves will not completely be closed in the nip between the rolls. However, this does not present any difficulties because non-fixed streaks with a width of a few tenth of millimeters are acceptable.

It is clear, that the circumferential grooves in the rolls 50 and 60, as represented in FIG. 2, have been arranged out of line with regard to each other, which guaranties more, that the circumferential grooves are properly closed in the nip. However, the shift between the circumferential groove in the roll 50 and the adjacent circumferential groove in the roll 60 is preferably smaller than the size of the holders 102 respectively 103 in the axial direction of the rolls 50 or 60, so that the holders form a better guiding for the image support 10. This means, that preferably the number of circumferential grooves in the roll 50 is equal to the number of circumferential grooves in the roll 60.

A further remark to be made is, that for a good performance of the fixing device it is necessary, that the rolls 50 and 60 rotate with a slightly lower circumferential speed than the circumferential speed of the transportrolls which transport the image support 10 to the fixing device 40, in the case of FIG. 1 the rolls 21 and 22, so that before the rolls 50 and 60 the image support is forced to buckle up. In this way it is possible to prevent that tensions occur in the image support which give rise to creasing, tearing and non-fixed image parts.

In the FIGS. 2 and 3 a second embodiment of a roll fixing device according to the invention is represented. The fixing device also consists of two rolls 110 and 60, which together form a nip through which the image support is transported, whereby the roll 110 has a modified construction with regard to the roll 50, and the roll 60 is in principle identical to the roll 60, described according to FIG. 1.

In order to obtain the required hardness of 20–30 Shore A for the roller 110, the following construction is used in this embodiment.

The roll 110 consists of a metal core 111, which can rotate freely in bearings in non-represented frameplates. Further the roll 110 is built up of four layers, which are from inside to outside: an adhesive layer 112, a hard layer 113, a soft layer 114 and an outer covering 115. Regarding material-choice the outer covering 115 can be identical with the outer covering 53 of the roll 50, as described according to FIG. 1.

In connection with the troubles occurring when soft silicon rubbers have to be adhered on a metal surface, first a layer 113 of silicon rubber with a hardness of 50 to 70 Shore A is fixed on the metal core 111 with the aid of a glue prepared on basis of silicon-compounds. On this hard layer 113 a soft layer which has a hardness being almost equal to the desired hardness of the total roll, is fixed, for instance by means of vulcanisation or by means of a usual silicon glue. Thus the hardness of this layer is equal to 20 to 30 Shore A. Finally the harder outer covering 115, for instance with a hardness of 35 to 40 Shore A, is applied.

The thickness of the various layers is of course also important for the final hardness of the roll. At a core diameter lying between ⅓ to ½ times the diameter of the final roll the thickness of the soft layer 114 is equal to 0.1 to 0.3 times the diameter of the final roll.

Tests with rolls with a diameter of 92 mm and a core diameter of 40 mm gave useful results, when the soft intermediate layer 114 had a thickness between 9 and 28 mm. The thickness of the outer covering thereby varied between 0.2 and 4 mm, whereas the combined thickness of the adhesive layer 112 and the hard intermediate layer was being adapted to the remaining dimensions in order to obtain a total diameter of 92 mm.

In the rolls 110 aand 60 circumferential grooves 116 respectively 117 have been applied, just like in the rolls 50 and 60 according to FIG. 1. These circumferential grooves 116 and 117 are identical to the circumferential grooves described according to FIG. 1.

In this embodiment of the invention the scraping organs are arranged as endless wires 118 respectively 119 which have been tightened round respectively the grooves 116 in the roll 110 and two auxiliary guides 120 and 121, and the grooves 117 in the roll 60 and two auxiliary guides 122 and 123. The auxiliary guides 120, 121, 122 and 123 are arranged as round rods 124, 125, 126 and 127, which can rotate freely in bearings in the non-represented frame plates. The round rods 124, 125, 126 and 127 at the height of the circumferential grooves 116 respectively 117 are provided with circumferential grooves 120, 121, 122 and 123 for guiding the wires 118 respectively 119.

In this way it is achieved that the wires 118 respectively 119 are moving, when the roll fixing device works, so that the wires 118 respectively 119 are less sensitive to wear. However, in principle it is also possible to fix the wires 118 respectively 119, for instance as finite wires, whereby the extremities of these wires are fixed to the auxiliary guides 120 and 121 respectively 122 and 123, and the wires pass through that part of the circumferential grooves 116 respectively 117 which is situated in the nip between the rolls 60 and 110.

Preferably the diameter of the wires 118 and 119 used is as small as possible. In connection with the pulling forces with act upon the wires 118 and 119, both in the case of moving wires as in the case of stationary wires a minimal diameter is required. When using a steel wire it appeared that the diameter could lie between 0.1 and 0.5 mm, whereby the results with the thicker kinds of wire were slightly less favourable than with the thinner kinds of wire and whereby the depth of the circumferential grooves was greater as the diameter of the wire increased.

It is clear, that also in this embodiment of the invention the circumferential grooves 116 respectively 117 are nipped together in the nip between the rolls 110 and 60 by the mutual pressure, so that the rolls 110 and 60 show an even surface in the nip. Preferably also here the circumferential grooves 116 and 117 are not lying in line with regard to each other, whereby preferably not too great axial distance over which two adjacent grooves 116 and 117 are lying from each other, should be chosen, in order to obtain a more effective guide of the image support.

In FIG. 4, a third embodiment of a scraping organ according to the invention is represented. This third embodiment is specially suitable for the roll 60 of the FIGS. 1, 2 and 3, for the case that this roll is covered with a very thin sleeve of powder repulsing material. In this case it is not possible to make the circumferential grooves in the roll 60 sufficiently deep in order that these would be closed in the nip.

Also here the scraping organs are formed by wires 119 which can move or be rigid, whereby also here moving wires are preferred. These wires pass at least in the nip through the circumferential grooves 116 of the roll 60 which have a depth being almost identical to the diameter of the wires 119 so that the grooves 116 are completely filled up.

By this combination it is reached that in the nip between the rolls the roll 60 shows an almost closed and even surface. This is important for the roll 60 in connection with the heat transmission to the image support and to the contact roll. Tests with the roll 60 according to FIG. 4 in combination with a roll 50 according to FIG. 1 have shown that, when no wires 119 would fill up the circumferential grooves 117, non-fixed streaks would occur on the image support, with a width which would be mainly identical to the width of the circumferential grooves. When using wires 119, which filled up the grooves almost completely, these non-fixed streaks disappeared. During these tests wires with a diameter of 0.2 respectively 0.3 mm were used.

FIG. 5 represents a fourth embodiment of scraping organs according to the invention, which is specially suitable for the contact roll 50 or 110 of the FIGS. 1, 2 or 3. The roll 130 (see FIG. 5) mainly has the same construction as the roll 110 of FIG. 2, but in the soft intermediate layer 114 a number of circumferential grooves 131 have been applied. In principle the circumferential grooves 131 can be arranged over the circumference of the roll 130 in a spiral shape but circumferential grooves 131 that are ring-shaped are preferred.

The circumferential grooves 131 are filled up with oblong pieces 132 of material which possesses a certain heat-resistance and sufficient elasticity. Suitable materials are soft or foamlike synthetic materials such as silicon-rubbers. The oblong pieces 132 have a radial size which is higher than the depth of the circumferential grooves 131, so that they project out of the outer circumference of the soft intermediate layer 114, and an axial width which is mainly equal to the width of the circumferential grooves 131.

Over the whole of these the outer covering 115 is installed in such a way, that at the heigth of the grooves 131 riblike thickenings 133 are formed which extend over the outer circumference of the roll 130.

In the nip of the fixing device, whereby as pressure roll one of the rolls described according to FIGS. 1 to 4 can be used, these riblike thickenings 133 are exposed to high pressures, so that in the nip the roll 130 shows a fully even surface. The pressure at the place of the riblike thickenings 133 is higher, but this has no influence on the copy quality.

Behind the nip the riblike thickenings 133 expand and push the image support from the roller surface in such a way, that at least in the immediate vicinity of the riblike thickenings 133 the support will come loose from the surface of the roll 130. The support can definitely be loosened from the roll surface with the aid of an airstream or a scraping organ, which will be described further on. The riblike thickenings 133 can also be realized in other ways, namely in that on a fully smooth intermediate layer 114 the outer covering 115 is applied in fluid or at least fluidly pliable mass, for instance in the form of a solution or an emulsion which upon hardening gives the required outer covering 115. During the hardening of the outer covering the roll 130 is turned, whereas over the outer surface a gauge with a profile which is opposite to the required profile of the roll, is scraping until the outer covering 115 has hardened out completely. The working of the roll manufactured in this way is identical to that of the roll described above.

FIG. 7 represents a third embodiment of a roll fixing device according to the invention. This device consists of two rolls 180 and 60, which together form a nip through which the support is transported, whereby the roll 180 has a modified construction with regard to the roll 50, and the roll 60 is in principle identical to the roll 60, described according to FIG. 1.

The roll 180 consists, as represented in FIG. 9, of a metal core 181, around which a sleeve 182 made of heat-resistant, elastically pliable material is applied, which sleeve 182 is in principle identical to the sleeve 52 of the roll 50, as described according to FIG. 1. Round the sleeve 182 a thin covering 183 is applied, which regarding the material-choice corresponds to the outer covering 53 of the roll 50, and in which ring-shaped thickenings 184 are applied, said thickenings being in principle identical to the thickenings 133 described in accordance to FIG. 5. A number of scraping organs 185, for instance three organs, cooperate with the ring-shaped thickenings 184 to completely loosen the support from the surface of the roll 180. The scraping organ 185 consists, as represented in FIGS. 15 and 16, of a substantially rectangular scraping plate, which is welded perpendicular to a triangular holder plate 187 along the greater part of its length.

The free end of the scraping plate 186 is provided with a profile that is adapted to the pertaining thickening 184. The holder plate 187 is provided with a bearing 188, with which the scraping organs 185 can be pushed on a rod 189, the rod being fitted between the frame plates of the device, which are not represented. Besides a distance roll 190 is mounted in a bearing 191 in the holder plate 187, which distance roll consists for instance of a ball-bearing 192 that is freely rotatable locked in the bearing 191 by means of a bolt-and-nut construction.

The diameter of the ball-bearing 192, which is in contact with the surface of the roll 180, and the location of the bearing 191 in the holder plate 187 is chosen in such a way that the profile of the free end of the scraping plate 186 is kept on a constant distance from the pertaining thickening 184, the constant distance being a few tenths of millimeters, for instance 0.2 mm.

The ball-bearing 191 is forced towards the surface of the roll 180 by means of a coiled spring 193, which is with one end connected to the frame and with the other end to a fastening 194 on the holder plate 187.

Thereby the ball-bearing reacts to every changing of the diameter of the roll 180, caused for instance by asymmetrical expansion or out-of-roundness of the roll, by correcting the position of the scraping organ 185 so that the distance between the free end of the scraping plate 186 and the pertaining thickening is kept constant.

In this embodiment the image support is removed from the pressure roll 60 by means of scraping organs consisting of a number of scraping knives 200, for instance two knives, which cooperate with the circumferential grooves in the roll 60.

The scraping knives 200, which have a modified construction with regard to the knives 100 of FIG. 1, consist, as represented in FIGS. 11 and 12, of holder plates 201 and 202, which in the axial direction of the roll 60 have such a point width, for instance 1 cm, that the image support can be guided by these holder plates without damage, and of knife blades 203 with a thickness in the size of a few tenths of millimeters, for instance 0.2 mm.

The holder plates 201 and 202 partially consist of angle sections for arranging the scraping knives to the frame in such a way that the knife blades 203 are situated in a perpendicular direction to the axis of the roll 60. The knife blades 203 extend in the circumferential grooves in the roll 60, which grooves are in principle identical to the circumferential grooves described according to FIG. 1. When, as schematically represented in FIGS. 19 and 20, the roll 60 and/or the scraping organ moves in the axial direction of the roll 60, the knife 200 will bend along a section according to the line AB in FIG. 11, which section can be any section somewhere in the knife 200, but preferably the section will be perpendicular to the longitudinal direction of the knife. As a result the knife 200 will bend in such a way that the sharp point of the front side of the knife blade 203 after bending sufficiently will contact the wall of the circumferential groove and damage said wall. To guard against this damage the scraping organ is improved according to another embodiment of the invention, as represented in FIGS. 13 and 14. In the holder of the scraping knife is therefor created a section which has a resisting moment to bending of a lower magnitude than that of any other section of the scraping knife. This section, according to the line CD in FIG. 13, is parallel to the front side of the knife blade so that the knife will bend as schematically represented in FIGS. 21 and 22.

When the knife blade which extends in a circumferential groove of the roll 60, is forced to bend in consequence of an axial movement of the roll and/or the scraping organ, the situation as represented in FIG. 22 arises. In this situation the front side of the knife blade is not only with one point, but with the whole front side in contact with the wall of the circumferential groove. By this line contact the chance of damaging the circumferential groove is less than said chance in case of a point contact between the knife blade and the wall of the groove. In order to create this weaker section in the scraping knife a part of the holder plates can be milled away or, as illustrated in FIGS. 13 and 14, the holder plates can be so attached that they leave open a weaker section in the holder.

Therefor an improved scraping organ 204 consists of a knife blade 205 on which four holder plates 206, 207, 208 and 209, two on each side, are attached. The holder plates 208 and 209 are executed as angle section in order to fit the scraping organs 204 to the frame so as to effect that the knife blade 205 is situated perpendicular to the axis of the roll 60.

As a result of the shape of the holder plates 206, 207, 208 and 209 a weaker section according to the line CD arises which can bend as described before and illustrated in FIG. 22.

In a fourth embodiment of a contact fixing device two rolls 210 and 60 together form a nip through which a support is transported, as represented in FIG. 8. The roll 210 has a modified construction with regard to the roll 180 of FIG. 7 and the roll 60 is in principle identical with the roll 60, described according to FIG. 1. This pressure roll 60 cooperates with a number of scraping knives, for instance two, which are preferably identical with the scraping knives 204.

The fixing roll 210 of this embodiment consists, as illustrated in FIGS. 8 and 10, of a metal core 211 round which a sleeve 212 and a covering 213 are applied, which core 211 and sleeve 212 are in principle identical with the core 181 and the sleeve 182 according to FIG. 7. The covering 213 is regarding material-choice identical with the covering 183 of FIG. 7, but in this covering a number of notches 214 are applied, which are arranged over the circumference of the roll 210 in a ring-shape. The notches 214 can be realized for instance in that on the sleeve 212 the outer covering 213 is applied in fluid or at least in fluidly pliable mass, for instance in the form of a solution or an emulsion which upon hardening gives the required outer covering 213. During the hardening of the outer covering the roll 210 is turned, whereas over the outer surface a gauge with a profile which is opposite to the required profile of the roll, is scraping until the outer covering 213 has hardened out completely. In the nip between the rolls 210 and 60, the surface of the roll 210 is exposed to high pressure, so that the notches 214 are closed and the roll shows a fully even surface.

A number of scraping organs 215, for instance three organs, cooperate with the notches 214 to remove the image support from the roll 210. The scraping organs 215 consist, as illustrated in FIGS. 17 and 18, of a substantially rectangular scraping plate 216, which is welded perpendicular to a triangular holder plate 217 along the greater part of its length. The free end of the scraping plate 216 is provided with a profile that is adapted to the pertaining notch 214. The holder plate 217 is provided with a bearing 218, with which the scraping organs 215 can be pushed on a rod 219, the rod being fitted between the frame plates of the device, which are not represented. Besides a distance roll 220 is mounted in a bearing 221 in the holder plate 217 which distance roll consists for instance of a ball-bearing 222 that is freely rotatable locked in the bearing 221 by means of a bolt-and-nut construction.

The diameter of the ball-bearing 222, which is in contact with the surface of the roll 210, and the location of the bearing 221 in the holder plate 217 is chosen in such a way that the profile of the free end of the scraping plate 216 is kept on a constant distance from the pertaining notch 214, the distance being a few tenths of millimeters, for instance 0.2 mm.

The ball-bearing 222 is forced towards the surface of the roll 210 by means of a coiled spring 223, which is with one end connected to the frame and with the other end to a fastening 224 on the holder plate 217. Thereby the ball-bearing 222 reacts to every changing of the diameter of the roll 210, caused for instance by asymmetrical expansion or out-of-roundness of the roll 210, by correcting the position of the scraping organ 215 so that the distance between the free end of the scraping plate 216 and the pertaining notch 214 is kept constant.

It is clear, that the various embodiments of the contact roll and the pressure roll can mutually be combined without affecting the good performance of the fixing device, and without deviating from the idea of the invention.

FIG. 6 represents at larger scale and in cross-section the temperature meter 150 which according to the invention is preferably used for measuring and regulating the surface-temperature of at least one of the rolls of the fixing device 40.

The temperature meter 150 is of the contactless type, which means that the surface temperature of the roll is measured without any measuring organ coming into contact with this surface. Hereby this measuring organ can for instance consist of a thermo-couple or an NTC-resistor.

If such a measuring organ would simply be installed close to the roll surface, it would not be possible to measure the temperature of the roll exactly with it, but a temperature would be measurued of which the value would be determined on the one hand by the surface temperature of the roll, and on the other hand by the ambient temperature. As the ambient temperature is not of constant value, but can vary within fairly wide limits, the measuring therefore is not exact either, so that consequently the temperature of the roll is also wrongly regulated.

In order to prevent the above mentioned troubles, the temperature meter 150 consists of a metal cylindrical housing 151, for instance made of aluminium. Round the housing 151 an electrically insulating layer 152 is applied and round this a heating spiral 153 consisting of so called resistance-wire. The heating spiral 153 ends on two connection strips 154 and 155 for the electrical connection of the heating spiral. Round the heating spiral again an electrically insulating layer 156 is arranged, and round this a thick heat-insulating covering 157.

In the inner wall of the heat-insulating covering 157 a notch 158 is made, which is connected with a bore in the outer and inner electrically insulating layers 152 and 156, which bore ends in a blind bore 159 in the aluminium housing 151. In the latter a temperature sensitive element 160, such as an NTC-resistor, is installed, of which the measuring head is situated as close as possible to the inner wall of the housing 151. The temperature sensitive element 160 is kept at its place by means of insulating paste 161, whereas the connection wires 162 and 163 of the element 160 are led outwards between the covering 157 and the layer 153.

Close to one of the extremities of the housing 151 the temperature sensitive element 165 is centrally installed. The temperature sensitive element 165 is fixed by means of heat-conducting paste on a plate 166 made of conducting material. This plate 166 consists of a circular part with a diameter which is smaller than the inner diameter of the housing 151 and of two fixation strips lying diametrally opposite to each other, with which the plate 166, and thus also the element 165 is fixed by soldering against the inner wall of the housing 151.

The construction is made in such a way, that the measuring head of the element 165 is mainly lying in a terminal flange of the housing 151.

Against this flange of the housing 151 a ring 167 made of hard tissue is installed, having a profile which has been adapted to the roll surface, of which the temperature must be measured. By means of this ring 167 it is possible to bring the housing 151 with the measuring element 165 so close to the roller surface, that between the roll and the ring 167 only a very narrow air gap is present, by which the influence of the air circulating with the roll is kept as small as possible.

The other extremity of the housing 151 is closed off by means of a stop 168 made of hard tissue, through which the connection pins 169 and 170 are put by way of lead-in wires 171 and 172. The connection pins 169 and 170 are connected with the connection wires 173 and 174 of the measuring element 165.

The working of the temperature meter is as follows: The housing 151 is heated by means of the heating spiral 153 and regulated with the help of a measuring element 160 for instance an NTC-resistor, which is taken up in a Wheatstone-bridge and with which the heating spiral 153 can be switched on and off at a temperature lying between the ambient temperature and the roll temperature, with the help of a measuring element 160. This has for consequence, that the air temperature at the inside of the housing is also regulated at this temperature, so that the influence of the ambient temperature is reduced to a minimum.

The measuring element 165 then commands the heating element of the roll, of which the temperature is measured, for instance the infra-red burner 70 of the roll 60. This measuring element 165 can also be an NTC-resistor which is taken up in a Wheatstone-bridge which produces a signal commanding the heating element 70.

It is clear, that numerous variations are possible without deviating from the basic idea. Thus it is possible to install the temperature meter opposite to a roll which is not heated directly, and to command the heating element of the other roll with this. Further it is possible to replace the heating spiral by other heating elements, for instance a power transistor.

It is also clear, that the invention is not restricted to the embodiment described and represented, but that various modifications can be applied without deviating from the idea of the invention. Thus the powder image on the support can be obtained in different ways, namely according to the indirect electrophotographic process, according to the direct electrophotographic process and even according to the electrographic process.

I claim:

1. Device for fixing a thermoplastic powder image on a support, comprising an elastic roller that is to contact the image side of the support and a substantially rigid roller having a surface sufficiently rigid to hold its shape under pressure against said elastic roller, said rollers together forming a nip through which the support is transported, the elastic roller comprising an elastically pliable annular body the outer surface of which is provided with at least one circumferential formation lying radially away from the contour thereof, and a separating organ complementary to and coacting with each said formation to assure separation of the support from said surface, each said formation being of such dimensions and said surface being sufficiently pliable that each said formation is deformed elastically by pressure of said rigid roller so as to form an even elastic roller surface in said nip.

2. Device according to claim 1, said elastic roller surface having a hardness of 20°–30° Shore A.

3. Device according to claim 1, said elastic roller comprising a metal core carrying said pliable annular body, said body comprising a relatively soft annular layer of an elastomer having a hardness approximating that required of said roller surface and an elastically pliable sheath on said soft layer.

4. Device according to claim 3, said layer and said sheath each being formed of a silicon elastomer.

5. Device according to claim 3, said relatively soft layer being supported on a relatively hard annular layer of plastic material adhered to said core by an adhesive layer.

6. Device according to claim 5, said relatively hard layer having a hardness of 55°–65° Shore A, said relatively soft layer having a hardness of 20°–30° Shore A and said sheath having a hardness of 35°–40° Shore A.

7. Device for fixing a thermoplastic powder image on a support, comprising an elastic roller that is to contact the image side of the support and a substantially rigid roller having a surface sufficiently rigid to hold its shape under pressure against said elastic roller, said rollers together forming a nip through which the support is transported, the elastic roller having an elastically pliable annular body the outer surface of which is provided with at least one elastically pliable riblike thickening of sufficiently small protending volume that each said thickening is depressed in the nip between the rollers so as to create an even elastic surface therein.

8. Device according to claim 7, each said thickening extending circumferentially of the elastic roller.

9. Device according to claim 7, each said thickening extending circumferentially of the elastic roller in the form of a ring.

10. Device according to claim 7, said annular body comprising two layers the outer of which has said at least one riblike thickening formed integrally and homogeneously therewith.

11. Device according to claim 7, said annular body comprising two layers the inner of which is formed with peripheral grooves having riblike strips of elastic material laid therein, the depth of said grooves being smaller than the radial size of said riblike strips, and the outer of said layers being a uniformly thick elastic sleeve which is protruded locally in riblike form by said strips.

12. Device according to claim 7, each said thickening extending circumferentially of the elastic roller in the form of a ring, and a separating organ cooperating with each said thickening, each said organ comprising a blade having a free end formed with a profile complementary to that of the pertaining riblike thickening and means for holding said blade inclined at an angle to the circumference of said elastic roller with said free end at a constant limited distance from said pertaining thickening.

13. Device according to claim 12, said holding means including a plate holding each said blade, a support rod, each said plate being freely pivotable upon said rod, a spring urging the blade toward the circumference of the elastic roller, and a freely rotatable roller carried on said plate and so located that by contacting and rolling on the circumference of the elastic roller it keeps said free end of said blade almost in contact with the pertaining riblike thickening.

14. Device for fixing a thermoplastic powder image on a support, comprising an elastic roller that is to contact the image side of the support and a substantially rigid roller having a surface sufficiently rigid to hold its shape under pressure against said elastic roller, said rollers together forming a nip through which the support is transported, the elastic roller having an elastically pliable annular body the outer surface of which has at least one circumferential groove formed therein, and a separating organ extending into each said groove, each said groove being of such dimensions and said surface being sufficiently pliable that the groove is pressed closed to form an even elastic roller surface in said nip.

15. Device according to claim 14, each said separating organ comprising a wire extending in and beyond that part of the pertaining circumferential groove which is situated in said nip.

16. Device according to claim 15, each said wire being fixed in place at its extremities.

17. Device according to claim 15, each said wire being of endless form and extending from the pertaining circumferential groove to and about at least one wire guiding element located opposite to that groove.

18. Device according to claim 15, each said wire having a diameter of 0.1 to 0.5 mm.

19. Device according to claim 14, each said groove having a depth of 2 to 5 mm.

20. Device according to claim 14, each said separating organ comprising a knife which extends into the pertaining circumferential groove.

21. Device according to claim 20, said knife comprising a blade which extends into the groove and a blade holder which almost but not quite touches the circumference of the roller.

22. Device according to claim 21, said knife blade having a thickness of 0.1 to 0.5 mm.

23. Device according to claim 21, said knife blade having a sloped edge fitting said groove, said blade holder lying substantially parallel to said blade and providing a weakened region sloped substantially parallel to said edge to enable lateral bending of said blade on an axis along the weakened region.

24. Device for fixing a thermoplastic powder image on a support, comprising an elastic roller that is to contact the image side of the support and a substantially rigid roller having a surface sufficiently rigid to hold its shape under pressure against said elastic roller, said rollers together forming a nip through which the support is transported, the elastic roller having an elastically pliable annular body forming a pliable outer surface and the rigid roller having a non-pliable sheath, said sheath having at least one circumferential groove formed therein, and a separating organ extending into each said groove to assure separation of said support from the rigid roller behind said nip.

25. Device according to claim 24, each said separating organ comprising a knife which extends into the pertaining circumferential groove.

26. Device according to claim 25, said knife comprising a blade which extends into the groove and a blade holder which almost but not quite touches the circumference of the roller.

27. Device according to claim 26, said knife blade having a thickness of 0.1 to 0.5 mm.

28. Device according to claim 26, said knife blade having a sloped edge fitting in said groove, said blade holder lying substantially parallel to said blade and providing a weakened region sloped substantially parallel to said edge to enable lateral bending of said blade on an axis along the weakened region.

29. Device according to claim 28, said blade holder comprising at least two holder plates fitted onto each side of the knife blade and mutually spaced apart to provide said weakened region.

30. Device according to claim 24, each said separating organ comprising a wire extending in and beyond that part of the pertaining circumferential groove which is situated in said nip.

31. Device according to claim 30, said wire substantially completely filling said part of the groove.

32. Device according to claim 30, wherein said rigid roller is internally heated and has a heat-conductive sheath, each said wire being composed of a heat-conductive material.

* * * * *